US008002684B2

(12) United States Patent
Laurent

(10) Patent No.: US 8,002,684 B2
(45) Date of Patent: Aug. 23, 2011

(54) VIBRATING PLATE APPARATUS FOR MUSCULAR TONING

(75) Inventor: Philippe Laurent, Mougins (FR)

(73) Assignee: FITHEALTH sarl, Valbonne - Sopia Antipolis (FR)

( * ) Notice: Subject to any disclaimer, the term of this patent is extended or adjusted under 35 U.S.C. 154(b) by 0 days.

(21) Appl. No.: 12/528,783

(22) PCT Filed: Feb. 28, 2008

(86) PCT No.: PCT/FR2008/000258
§ 371 (c)(1),
(2), (4) Date: Aug. 26, 2009

(87) PCT Pub. No.: WO2008/129162
PCT Pub. Date: Oct. 30, 2008

(65) Prior Publication Data

US 2010/0105524 A1 Apr. 29, 2010

(30) Foreign Application Priority Data

Feb. 28, 2007 (FR) ..... 07 01435

(51) Int. Cl.
*A63B 26/00* (2006.01)
*A63B 21/005* (2006.01)

(52) U.S. Cl. ..... 482/142; 482/6

(58) Field of Classification Search ..... 482/4, 54, 482/61, 80, 146, 133, 66; 601/49
See application file for complete search history.

(56) References Cited

U.S. PATENT DOCUMENTS

| | | | | |
|---|---|---|---|---|
| 4,133,305 | A * | 1/1979 | Steuer | 601/55 |
| 4,231,355 | A * | 11/1980 | Hara | 601/18 |
| 5,879,276 | A * | 3/1999 | Miller | 482/146 |
| 6,217,533 | B1 * | 4/2001 | McCambridge | 601/56 |
| 6,440,092 | B1 * | 8/2002 | Leventhal et al. | 601/148 |
| 6,695,798 | B2 * | 2/2004 | Chang | 601/49 |
| 7,374,522 | B2 * | 5/2008 | Arnold | 482/146 |
| 7,402,145 | B1 * | 7/2008 | Woggon et al. | 601/49 |
| 2003/0073550 | A1 * | 4/2003 | Hsu | 482/142 |
| 2004/0067833 | A1 * | 4/2004 | Talish et al. | 482/148 |
| 2005/0131319 | A1 * | 6/2005 | der Meer | 601/49 |
| 2005/0165332 | A1 * | 7/2005 | Talish et al. | 601/23 |
| 2006/0253053 | A1 * | 11/2006 | Koonar | 601/49 |
| 2007/0219052 | A1 * | 9/2007 | Schuurman et al. | 482/1 |
| 2007/0239088 | A1 * | 10/2007 | Wu | 601/49 |
| 2008/0275373 | A1 * | 11/2008 | van der Meer | 601/49 |
| 2009/0264801 | A1 * | 10/2009 | Van der Meer | 601/70 |
| 2010/0125025 | A1 * | 5/2010 | van der Meer | 482/4 |
| 2010/0184568 | A1 * | 7/2010 | Schippers et al. | 482/51 |

* cited by examiner

*Primary Examiner* — Rinaldi I Rada
*Assistant Examiner* — Robert F Long
(74) *Attorney, Agent, or Firm* — James C. Lydon

(57) ABSTRACT

A vibrating plate apparatus including a vibrating plate on which a user rests, a vibration motor member connected to the vibrating plate, several air cushions provided under the vibrating plate for dampening vibration, and an air tank in communication with each of the air cushions. The tank establishes the air pressure in at least one of the air cushions at a predetermined value independently from the user's weight. The motor member includes two motors rotating in opposite directions, each of the two motors including a set of flyweights driven by the two motors and having a center of gravity offset relative to the axis, the two sets having the same mass, being symmetrical to each other and including at least one moveable flyweight that can assume at least one position to vary the vibrating plate's vibration amplitude.

11 Claims, 4 Drawing Sheets

VIBRATING PLATE APPARATUS FOR MUSCULAR TONING

TECHNICAL FIELD

The present invention relates to the fitness apparatus used in gyms but also concerns apparatus used in physiotherapy, proprioception and posture. More particularly, this invention concerns a vibrating apparatus for muscular toning.

STATE OF THE ART

Nowadays, in gyms and fitness centres there are apparatus with a vibrating plate thanks to subjacent motors that generate unidirectional and vertical vibrations. As someone stands on the vibrating plate in operation, his body is affected by a small unsteadiness. The brain receives this information and delivers a signal to the muscles in order to cause reflex muscular contractions to proceed to a readjustment.

Most vibrating plate apparatus are currently equipped with means for absorption using springs or plates made of elastic material. But this kind of absorption doesn't enable an optimum adjustment adapted to a user's weight. In this way, vibrations for a 75 kg person will be too strong for another who weighs less than 75 kg and too weak for those with a weight of more than 75 kg. The patent request no WO 2005/0001888 describes such an apparatus with the possibility of modifying the thickness of the elastic material. However, on one hand, it is not easy to make this modification for each user and on the other hand, the few possibilities don't enable adjustment of the absorption according to the user's precise weight.

There are today vibrating plate apparatus whose absorption is realized by pneumatic suspensions such as air cushions. This type of absorption erases the above disadvantages but has a major disadvantage: the cushions deflate gradually and the temperature has generated the expansion of the contained air, which causes an undesirable variation of air pressure.

Moreover, the current vibrating plates apparatus having air cushions are not adapted to the user needs, which are very different for an important muscular recruitment, for seniors, for young people or for pathologies of the musculoskeletal system.

SUMMARY OF THE INVENTION

That is why an object of the invention is to provide a vibrating plate apparatus having adjustable air cushions to absorp as accurately as possible based on the weight of any user.

Another object is to provide a vibrating plate apparatus whose vibration can be adapted to any user's need.

The present invention is a vibrating plate apparatus that comprises a vibrating plate on which the user desiring muscular toning rests, a vibration motor member connected to the vibrating plate for vibrating the latter at a predetermined frequency, a plurality of air cushions provided under the vibrating plate for dampening the vibration effect, and an air tank in communication with each of the air cushions and in which the air pressure is maintained at a predetermined value. The tank establishes the air pressure in at least one of the air cushions at a predetermined value independently from the weight of the user. The motor member includes two motors rotating in opposite directions, each of the two motors including a set of flyweights driven by the rotation axis of the motors and having a centre of gravity that is offset relative to the axis, each of the two sets having the same mass and being symmetrical relative to each other and including at least one movable flyweight that can assume at least one position for varying the vibration amplitude of the vibrating plate.

According to a characteristic of the invention, the apparatus also includes a computer with a tactile screen and a keyboard in order to enter the functioning programs of the vibrating plate together with the necessary parameters such as the pressure value in the air cushions or the vibration frequency of the vibrating plate.

Another feature of the invention is a plurality of vibrating plate apparatus which are controlled by a computer under the control of a coach: this enables to start the all apparatus together with a remote control according to a special program and with accurate parameters such as the pressure value in the air cushions or the vibration frequency of the vibrating plate.

BRIEF DESCRIPTION OF THE FIGURES

The objects and characteristics of the invention will be clearly defined in the following description in reference to the following figures in which.

DETAILED DESCRIPTION OF THE INVENTION

Figure 1:
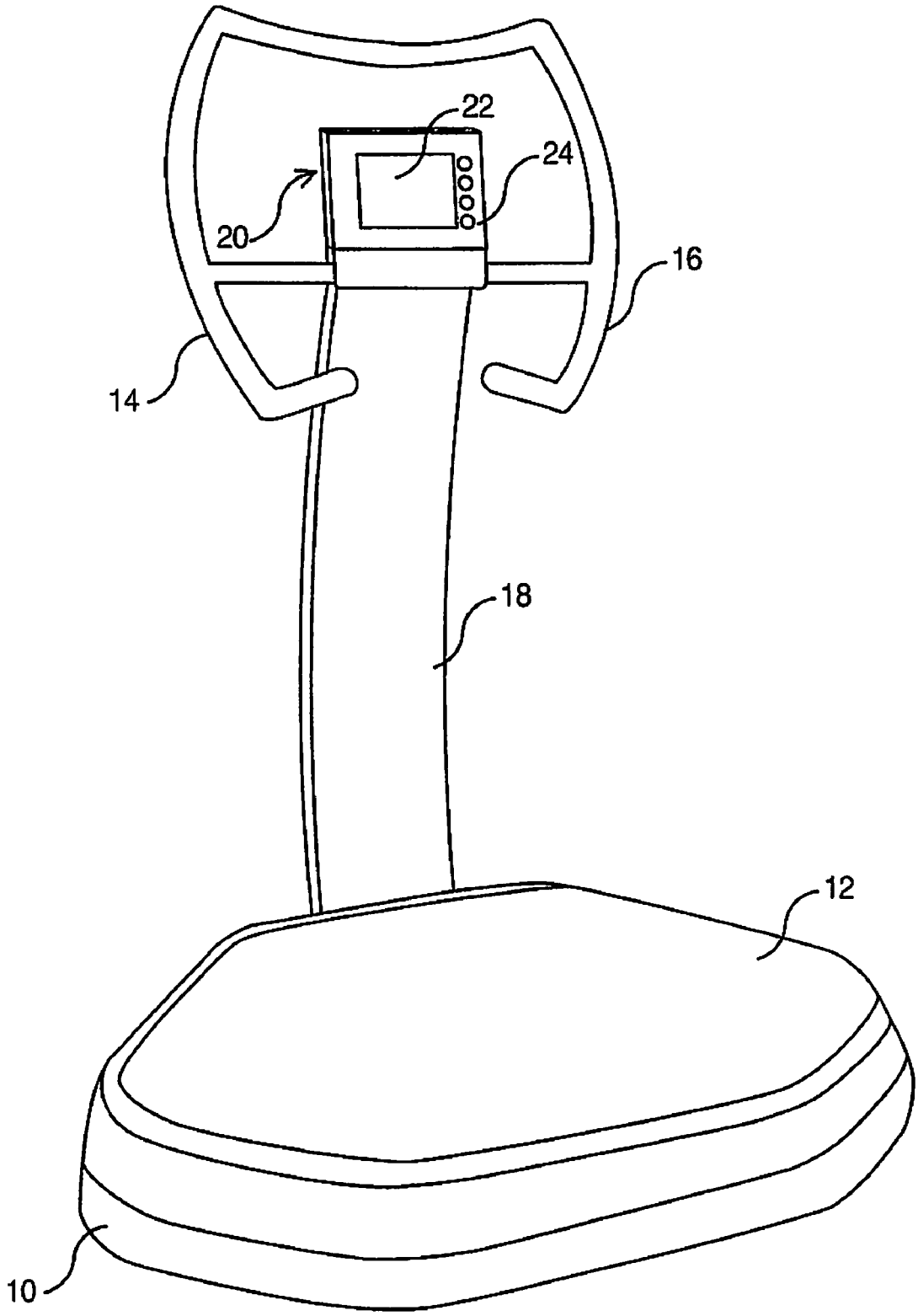
FIG. 1 shows a vibrating plate apparatus according to the invention.

In reference to FIG. 1, a vibrating plate apparatus according to the invention encloses a base 10 supporting a vibrating plate 12 in a horizontal position on which the user stands on. The vibrating plate could have different dimensions but it should be better if it had dimensions of about 1 m length and 60 cm width for a stout build user who wanted to lie on the vibrating plate without any problem.

The vibration motor member is subjacent to the vibrating plate 12 and is not visible on the diagram. This motor member enables the vibration of the plate in a vertical direction having an amplitude between 1 mm to 3 mm.

The user standing on the vibrating plate keeps the position holding the handles 14 and 16 of a wheel fixed to the base 10. Between the two handles 14 and 16, there is a computer enclosing a screen 22 and a keyboard 24 fixed at the top of the jamb 18.

This computer enables various functions, particularly to select the using frequencies, the pressure in the air cushions, low or high amplitude, the exercise time, the pause time between each exercise. It also enables to change the frequencies or the amplitudes during the exercises. It may be noted that the pressure in the air cushions is maintained to 1.5 $kg/cm^2$ whatever the user weight unless the user chooses a specific program.

Figure 2:
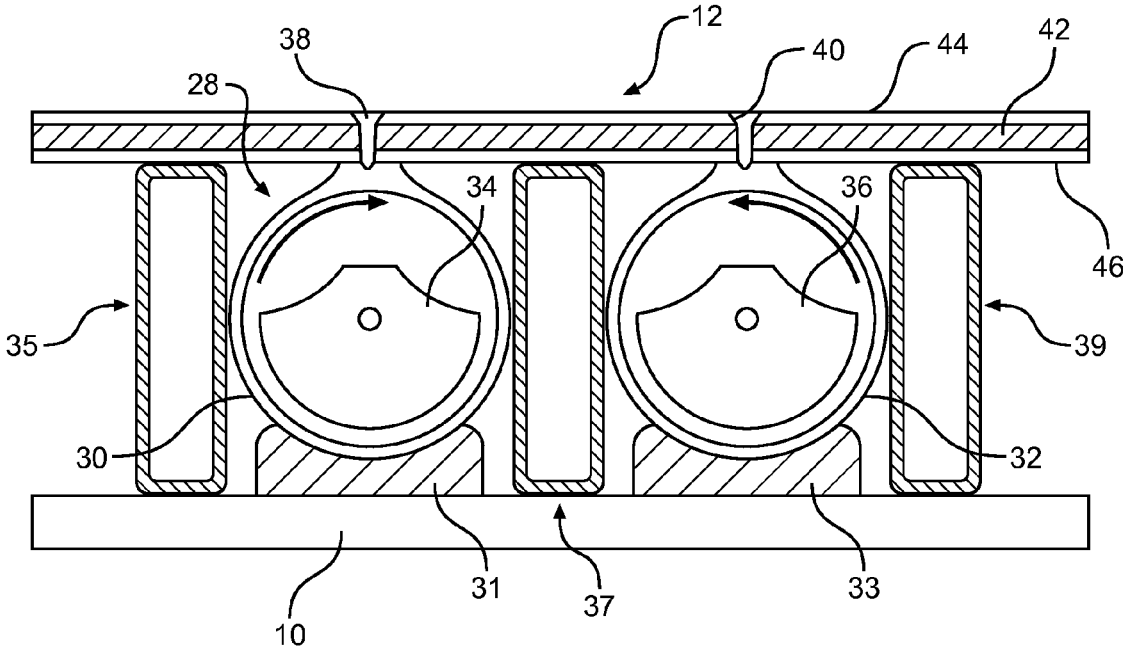
FIG. 2 shows a section of the two rotative motors enclosing the vibration motor member in a preferential mode of realization according to the invention.

The vibrating plate 12 is under vibration by a vibration motor member represented in FIG. 2.

The motor member includes two motors rotating in opposite directions, the motor 30 whose support 31 is fixed on the base 10 and the motor 32 whose support 33 is also fixed on the base 10. Each motor 30 and 32 includes a set of various fixed flyweights 34 for the first motor and fixed flyweights 36 for the second one. The center of gravity of the fixed flyweights sets 34 and 36 is offset relative to the axis of their motors 30 adm 32. The two fixed flyweight sets are symmetrical to each other.

The vibrating plate 12 is fixed to the frame of each rotative motors 30 and 32 respectively by two screws 38 and 40. In this way, the vibrating plate 12 is subjected to a vibration which has the frequency of the frequency rotation of the motors and 32. Air cushions 35, 37 and 39 are located under vibrating plate 12.

It may be noted that the vibrating plate 12 includes principally a steel plate 42 with a width between 1 cm and 1.5 cm that avoids the distortion: under vibration effects, accelerations at starting can raise up to 10 g (10 times gravity). The vibrating plate preferably includes an upper coat 44 made of a soft rubber material, for example ABS, in order to provide a favorable absorption for the user, and a rigid lower coat 46 made of rubber material but having ribs to increase rigidity.

As the motors are in rotation, each set of flyweights induces a centrifugal force by turning.

Figure 3:
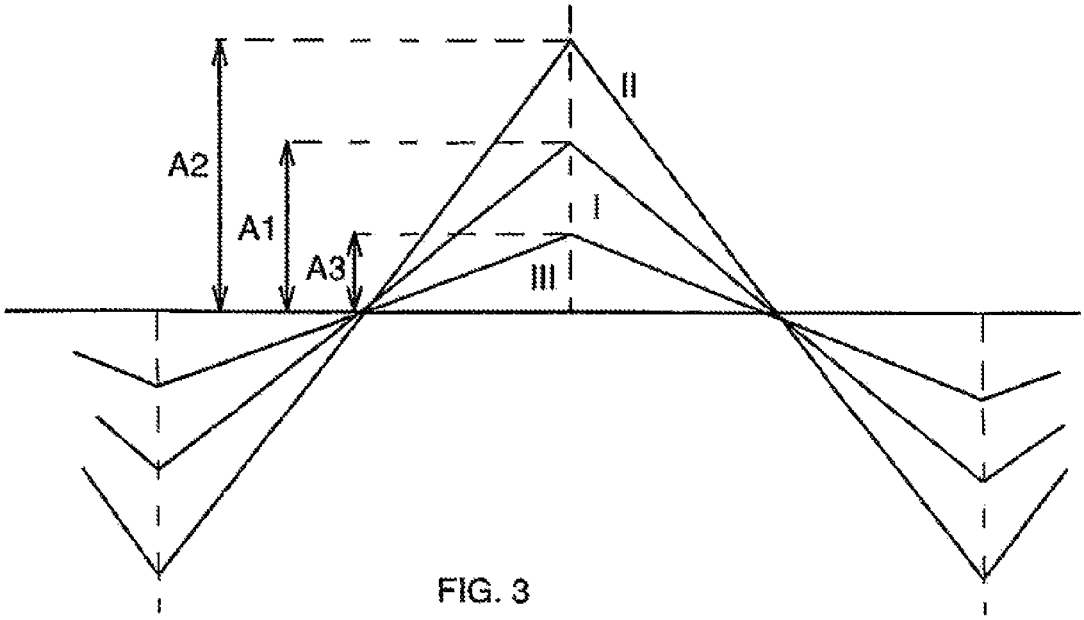
FIG. 3 shows a diagram of the amplitude variation of the vibration applied to the vibrating plate according to the movable flyweight of the motor member in a preferential mode of realization.

In the simplest case showed in FIG. 2, the two flyweight sets are in a lateral position, the centrifugal forces executed laterally but in an opposite direction and then cancel each other out. On the other hand, as the flyweight set is at the top or at the back, the centrifugal forces add up and then create an alternative vertical force whose frequency is the rotation frequency of the rotative motors. The vibrating plate goes from a high position to a low position as illustrated in FIG. 3. Then, its position varies from an amplitude A1 (for example 1.5 m) to the top to an amplitude A1 to the back in reference with the pause position.

Figure 4A:
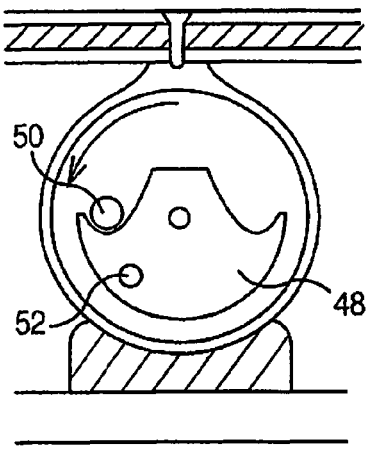
FIGS. 4A, 4B & 4C show respectively the movable flyweight of the motor member position in a preferential mode of realization.
Figure 4B:
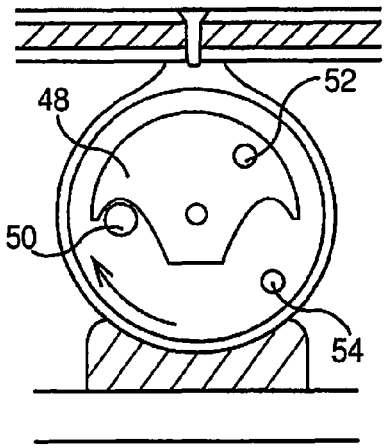
Figure 4C:
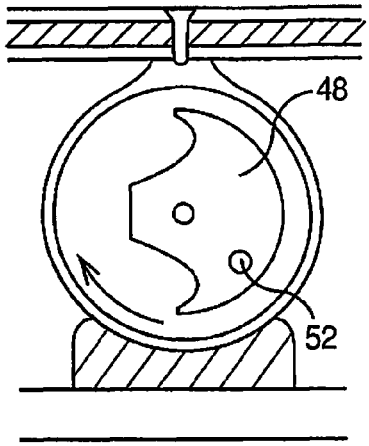

In order to vary the vibration amplitude of the vibrating plate for a better adaptation to each user, the preferential mode of realization consists in having at least one flyweight of each flyweight set (the two being always symmetrical) in a movable position and different from the other flyweights of the set as showed in FIGS. 4A, 4B and 4C.

In this precise case, each motor includes a flyweight whose position can be modified while the other flyweights of the set are fixed to the motor by cotter pins.

It may be noted that the flyweights of each set are preferably the same. For example, each set can include two flyweights fixed to the motor and one in a movable position, the flyweights having a mass of 100 g each.

In a first position showed in FIG. 4A, movable flyweight 48 is in low position; it is situated in superposition of the flyweights also fixed in low position. The motor represented in the figure turns anticlockwise (the other motor turns clockwise); movable flyweight 48 is blocked and carried in rotation by the stop 50 interdependent with the motor. In this configuration, the masses of all the flyweights add up and the amplitude to the back or to the top A2 is more important than the simple case of the flyweight in FIG. 2 as shown in FIG. 3. Such amplitude (for example 2 mm) enables a muscular recruitment and requests more deeply the other elements of the user's musculoskeletal system as articulations, tendons and ligaments.

In a second position shown in FIG. 4B, movable flyweight 48 is in a high position, that is to say at 180° regarding the other flyweights fixed to the motor always in low position. The motor turning clockwise (the other motor turns anticlockwise), the movable flyweight 48 is locked and carried in rotation by the stop 50 interdependent with the motor. In this configuration, the flyweight mass subtracts from the total mass of the other flyweights and the vibration amplitude A3 is less important (for example 1 mm) as shown in FIG. 3 than the simple case in FIG. 2. Weaker amplitude is interesting for requesting a muscular recruitment of low intensity to avoid harmful side effects on the other structures of the musculoskeletal system. This amplitude can be used by the elderly, very young people or someone who suffers from pathologies of musculoskeletal system.

Figure 5:
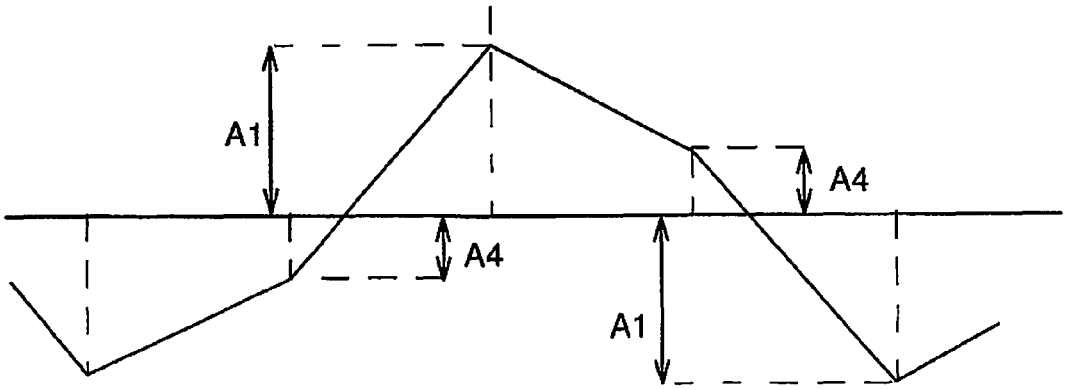
FIG. 5 shows a diagram of the amplitude variation of the vibration of the motor member in an intermediate position.

In a third position shown in FIG. 4C, the movable flyweight 48 is in an intermediate position, at 90°, between the positions of FIGS. 4A and 4B. This can be done with a magnetic element 52 of the movable flyweight 48 which is going to stick against an electromagnet 54 activated in this case. Considering the motor turning anticlockwise (the other motor turns clockwise), the vibration amplitude of the vibrating plate is represented in FIG. 5. After obtaining a maximum amplitude A1 to the back by the fixed flyweights in low position, a medium amplitude A4 but not equal to zero to the back is obtained as the forces due to the flyweights in median position cancel up but as the movable flyweight 48 is in low position for the two motors. Again, the amplitude A1 to the top is obtained as movable flyweight 48 is in a median position when the fixed flyweights are in high position. Then, a medium amplitude A4 to the top is reached as movable flyweight 48 is in high position.

In this mode of realization (it can be called "double wave") in comparison with the modes of realizations whose amplitude variation is represented in FIG. 3 (it can be called "simple wave"), the "jerks" produced as the amplitudes are A4 to the top or to the back are similar to tiny unsteadiness that cause a muscular recruitment by myotatic reflex. The vibration is no longer unidirectional but has multidirectional components that enable different stimulations to the human body. The skin and proprioceptive receivers are then requested in very different tangential components and request proprioceptive reflexes of different muscular stimulation of vertical vibration. Stabilizing muscles of articulations, different from those which are sensible to a vertical vibration are stimulated to request to touches in shearing of those articulations. The muscular recruitment of a multidirectional vibration is much larger (more recruited muscles in a same exercise with a more important intensity than without any vibration).

The real absorption is provided by air cushions situated between the vibrating plate and the base; there can be 2, 3, 4 or more. In the preferential mode of realization, the apparatus includes 3 air cushions as described below.

An air cushion is preferably circular and has a diameter between 5 cm to 10 cm. It is made of an elastic material such as rubber. The elastic material comprises a rigid layer to be used for a support at its lower part and at its upper part, a layer in communication with the interior of the air cushion and to be used for air inlet and air outlet. Air inlet and air outlet can be done thanks to electro pneumatic converters 56-1, 56-2, 56-3 controlled by an automaton as discussed below.

Figure 6:
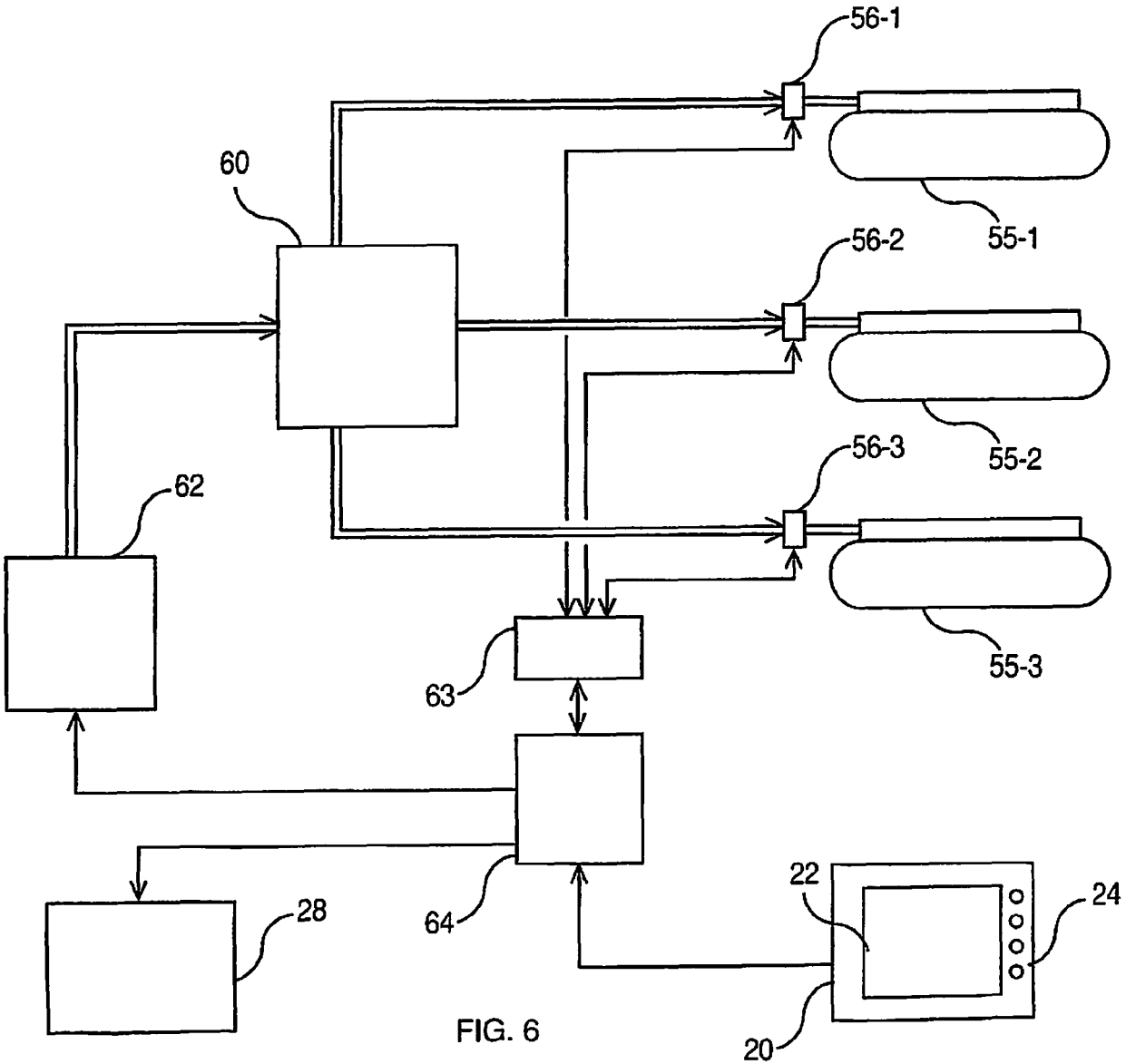
FIG. 6 is a diagram block showing the connection between the air cushions, the compressor, the air tank, the control unit, the automaton and the electro pneumatic converters.

The absorption implementation which is an important characteristic of the invention is now explained in reference with FIG. 6. According to the preferential mode of realization, the vibrating plate apparatus comprises 3 air cushions 55-1, 55-2, 55-3. Each air cushion can receive air under pressure and let the air out.

The air is provided to the air cushion by an air tank 60 of a capacity of many air litters. The air present in the tank 60 is provided by compressor 62.

A pre-determined pressure, for example 2 kg/cm$^2$, is maintained inside the tank 60. As soon as the pressure decreases, the compressor starts in order to restore the pressure up to the pre-determined value. This adjustment is easily realized thanks to a regulator of pressure inside the tank acting on the compressor starting.

The sequence of air inlet and air outlet in the air cushions is determined by an analogical automaton 63 which receives sequence instructions by the order unit 64 connected to the computer 20. As discussed above, the program implementation is entered in the computer by a tactile screen 22 and a keyboard 24. The program parameters, such as the pressure in the air cushions, are transmitted to the order unit 64. Then, the latter orders the starting of the motor member 28 and transmits the signals of the sequence order to the automaton which sends electric signals to the electro pneumatic converters 56-1, 56-2 and 56-3. These electric signals are transformed into pressure signals for regulating the pressure respectively in the air cushions 55-1, 55-2 and 55-3. Supposing the pressure in the air cushions should be established to 1.5 kg/cm$^2$ whatever the user weight and that the pressure is only 1.4 kg/cm$^2$ in the air cushion 55-1, the order unit 64 will transmit an opening signal to the automaton 63. Some air under pressure at 2 kg/cm$^2$ present in the air tank 60 goes into the air cushion 55-1 up to the pressure in the latter reaches 1.5 kg/cm$^2$.

In case of the pressure in one or various air cushions is too high, the order unit 64 sends an opening signal to the automaton 63. Supposing the air pressure in the air cushion 55-2 is 1.6 kg/cm$^2$ and that this pressure should be decreased to 1.5 kg/cm$^2$, air will be drained from the air cushion 55-2 by the electropneumatical converter 56-2 until the pressure in the air cushion had been decreased to 1.5 kg/cm$^2$.

It may be noted the pressure in the air cushions must be increased or decreased by an inverse proportional way: if a 100 kg user uses the apparatus after a 75 kg user, the pressure will have to be decreased in the air cushion. In contrast, if the next user weights only 60 kg, the pressure will have to be increased in the air cushions.

Pressure value signals are transmitted all the time by the electropneumatical converters 56-1, 56-2 and 56-3 to the automaton 63, which sends signals to the order unit 64. This one can decide to transmit if necessary opening signals to one or various electropneumatical converters.

According to a variation of the mode of realization that has just been described, as the user goes down the vibrating plate, the pressure in the air cushions falls and this pressure decrease is detected by the order unit 64. The order unit sends a signal to the automaton 63 which orders to the electropneumatical converters to open and deflate the air cushions, which makes the vibrating plate go down.

As another user stands on the vibrating plate in its low position, he is detected thanks to the pressure exerted on it; the order unit sends a signal to fill the air cushions up to the desired pressure. It may be noted that returning to the reference pressure of the vibrating plate as the user stands on the vibrating plate can be done in one of two ways: either by reequilibration by the automaton which converts the signals of pressure variation in the air cushions (transmitted by the electropneumatical converters) into signals of pressure adjustment or by a seat correction by the automaton which transmits the order signals to the electropneumatical converters to go back to the reference height of the vibrating plate.

According to the invention, the most common use of the vibrating plate is to produce the same vibration in all the vibrating plate which is subjected to an alternative and vertical movement by keeping its horizontal with amplitude between 1 mm and 3 mm. In order to do this, the air cushions are filled by the same way with the same pressure. However, another use consists in increasing and decreasing alternatively the pressure in the air cushions, one is inflated to a pressure of 1.5 kg/cm$^2$ as the second one to a pressure of 1.2 kg/cm$^2$ and the third one is only to a pressure of 0.9 kg/cm$^2$. The vibrating plate doesn't stay horizontal but each part of it goes up and down alternatively.

The modes of realization that have just been described together with other ones are programmed with the computer 20. It may be noted that the computer 20 enables hands-free use by the client thanks to a program "client gestion". The latter enters his name and his code number and the apparatus functions for 30 or 45 minutes. After this time, if the client wants to continue his exercises, he has to reenter his name and his code number; and then, a new session will be deducted from his package.

The computer 20 can analyze the muscle capacity of contraction of each user, in order to regulate exactly the vibration force necessary according to the muscular receptivity appropriate for any user (biofeedback).

In this way, with a frequency of 35 hz, the thigh muscle of a user X will contract very strongly (it is no use increasing the frequency on pain of muscle tetanization), where as the thigh muscle of another user will contract weakly at the same frequency: the reason for increasing the frequency is to obtain an optimum work which is necessary for him.

The computer enables analysis of the body masses of each user (bio-impedancemetry): fat, lean and water body mass. This function enables the user to follow his progress step-by-step (fat loss and muscle mass gain) over time.

Moreover, one of the features of the invention consists in pulling down programs in the computer 20 which generate random frequencies of vibration of the vibrating plate together with random sequences of pressure values in the air cushions.

It may be noted that the implementation of the programs order can be done by a remote control device. It may be noted also that it is possible to control multiple apparatus with one computer under the control of a coach. In this case, multiple users can exercise simultaneously and enjoy the accurate instruction of the coach.

The invention claimed is:

1. Vibrating plate apparatus, comprising a vibrating plate adapted to support a user desiring muscular toning, a vibration motor member connected to the vibrating plate and adapted to vibrate said plate at a pre-determined frequency, a plurality of air cushions provided under said vibrating plate and adapted to dampen vibrations, and an air tank in communication with each of the air cushions and adapted to maintain an air pressure of said air cushions at a pre-determined value, wherein said tank is adapted to establish the air pressure in at least one of the said air cushions at a pre-determined value independently from a weight of the user;

wherein said vibration motor member includes two motors rotating in opposite directions, each of the two motors including a set of flyweights driven by a rotation axis of the motors and having a center of gravity that is offset relative to the axis, wherein both sets of flyweights have the same mass and are symmetrical relative to each other and include at least one movable flyweight that can assume at least one position for varying a vibration amplitude of said vibrating plate, wherein said set of flyweights comprises at least one flyweight fixed to said motor member and wherein said movable flyweight is in an intermediate position at 90° in reference to a position of said fixed flyweight in order to cause a slope change of the amplitude vibration of said vibrating plate so as to obtain a double wave.

2. The apparatus of claim 1, wherein a compressor provides air under pressure to said tank in order to keep the air pressure in the said tank at a pre-determined value.

3. The apparatus of claim 2, wherein said pre-determined value of the air pressure in said tank is higher than the air pressure in each air cushion, and said tank communicates with each of said air cushions through an electropneumatical converter under an automaton order so that air under pressure can go into said air cushions as necessary.

4. The apparatus of claim 3, wherein said pre-determined value of the air pressure in said tank is 2 $kg/cm^2$ and said determined value of the air pressure present in at least one of said air cushions is 1.5 $kg/cm^2$ independently from a user's weight.

5. The apparatus of claim 3, wherein said apparatus further comprises an order unit connected to said automaton and adapted to order at least one of said electropneumatical converters as necessary to increase or decrease an air pressure in the corresponding air cushion.

6. The apparatus of claim 5, wherein said electropneumatical converters are adapted to detect an air pressure value in the associated cushions and provide said pressure value to said order unit through said automaton so that said automaton can send an order signal to at least one of said electropneumatical converters, if necessary to increase or decrease the air pressure in the associated air cushion.

7. The apparatus of claim 6, wherein said pressure is kept at the same value in each of said air cushions in order that said vibrating plate is subjected to a vertical alternating movement and a constant horizontal movement having an amplitude between 1 mm and 3 mm in accordance with a position of said movable flyweight.

8. The apparatus of claim 6, wherein said air pressure value in said air cushion is alternatively increased and decreased under the order of said order unit in order to impart an oscillating and turning movement to the vibrating plate.

9. The apparatus of claim 6, further comprising a computer adapted to be controlled by a coach in order to operate said vibrating plate apparatus according to a determined program using a parameter such as the pressure value in said air cushions or a vibration frequency of said vibrating plate.

10. The apparatus of claim 1, wherein said apparatus further comprises a computer operable by a user, said computer comprising a tactile screen and a keyboard, wherein said keyboard is adapted to enter functioning programs of said apparatus together with at least one parameter such as an air pressure value in the air cushions or a vibration frequency to said vibrating plate, and said tactile screen is adapted to enter a user's name and code number in order to make the apparatus operational during a determined time.

11. The apparatus of claim 10, wherein said functioning programs include means for generating random vibration frequencies of the vibrating plate and random air pressure values for the air cushions.

* * * * *